United States Patent [19]

Helling et al.

[11] 4,284,708

[45] Aug. 18, 1981

[54] PHOTOGRAPHIC FILM UNIT FOR THE PRODUCTION OF COLORED TRANSFER IMAGES

[75] Inventors: Günter Helling, Cologne; Werner Krafft, Leverkusen; Kurt Findeisen, Odenthal; Wolfgang Himmelmann, Leverkusen, all of Fed. Rep. of Germany

[73] Assignee: Agfa-Gevaert Aktiengesellschaft, Leverkusen, Fed. Rep. of Germany

[21] Appl. No.: 131,635

[22] Filed: Mar. 19, 1980

[30] Foreign Application Priority Data

Mar. 24, 1979 [DE] Fed. Rep. of Germany ..... 2911694

[51] Int. Cl.[3] ..... G03C 1/40; G03C 1/48

[52] U.S. Cl. ..... 430/216

[58] Field of Search ..... 430/215, 216

[56] References Cited

U.S. PATENT DOCUMENTS 3,730,718 5/1978 Danhauser ..... 430/215

4,029,504 6/1977 Secrist et al. ..... 430/216

FOREIGN PATENT DOCUMENTS 1295310 5/1969 Fed. Rep. of Germany .

2019430 11/1971 Fed. Rep. of Germany .

2049668 4/1972 Fed. Rep. of Germany .

2800357 7/1979 Fed. Rep. of Germany .

7533741 10/1975 France .

*Primary Examiner*—Richard L. Schilling

*Attorney, Agent, or Firm*—Connolly and Hutz

[57] ABSTRACT

A photographic film unit for the production of colored transfer images contains an integral neutralization system consisting of an acid polymer layer and a retarding layer. The acid polymer layer consists of a copolymer of 5 to 50 % by weight of polymerized carboxyalkyl (meth)acrylate units together with other acid monomers and optionally nonacid monomers. A preferred carboxyalkyl (meth)acrylate is the dimeric acrylic acid. The acid polymer has high acid number and low glass transition temperature.

4 Claims, No Drawings

PHOTOGRAPHIC FILM UNIT FOR THE PRODUCTION OF COLORED TRANSFER IMAGES

This invention relates to a photographic film unit for producing color photographic images by the dye diffusion transfer process and, more particularly, to a neutralizing element for such a film unit which element consists of an acid polymer layer and of a retarding layer and in which the acid polymer layer contains a copolymer containing at least 5 mole percent of carboxy alkyl (meth) acrylate units.

The dye diffusion transfer process is normally carried out with a photosensitive element containing color providing compounds and an image-receiving element in which the required dye image is produced by diffusing dyes transferred in image-wise distribution. To achieve this, the photosensitive element and the image-receiving element have to be kept in firm contact with one another for at least a finite period of time during the development process so that the image-wise distribution of diffusing dyes produced in the photosensitive element in consequence of development may be transferred to the image-receiving layer. The requisite contact may be established after development has started or, alternatively, may already have been established before development begins. The latter is the case for example where a material in which the photosensitive element and the image-receiving element form an integral unit is used for carrying out the dye diffusion transfer process. Embodiments of the dye diffusion transfer process are known in which an integral unit such as this remains intact even after completion of the development process. In other words, the photosensitive element is not separated from the image receiving element, even after the completion of dye transfer. One such embodiment is described for example in German Offenlegungsschrift No. 2,019,430. According to another embodiment, however, the image-receiving element, which carries the completed image after dye transfer, may also be separated from the photosensitive element, for example by means of a peel-off layer arranged between the two elements. One such embodiment is described for example in German Offenlegungsschrift No. 2,049,688.

The imagewise exposed photosensitive element is treated with an alkaline developer preparation to develop the silver halide and to produce an image-wise distribution of diffusing dyes which is transferred to the image-receiving element. In general, no provision is made for subsequent washing. However, it is necessary for the high pH-value adjusted during development in the image receiving layer to be reduced in order to fix definitively the image dyes in the image-receiving layer and effectively to terminate the development process. The latter is important above all in cases where the image-receiving element forms an integral unit or a so-called monosheet with the photosensitive element. Known measures for reducing the pH-value comprise for example arranging a so-called neutralisation system in close spatial relationship to the image-receiving layer. This neutralisation system consists of a neutralising layer which contains a polymer having free acid groups and of a retarding layer which retards neutralisation and which contains a polymer offering a certain resistance to the diffusing hydroxyl ions. One such neutralisation system is described for example in German Pat. No. 1,128,310.

It is known that polymeric organic acids, preferably in partially esterified form, may be used for producing the neutralising layers. The polymers may be used either in the form of organic solutions as described in French Pat. No. 7,533,741 or in the form of aqueous dispersions as described in Belgian Pat. No. 860,771.

The disadvantage of the hitherto described acid polymers is either their low acid number, defined as the number of acid equivalents per weight unit of copolymer, or—given a high acid number—the brittleness of the acid polymer layers which is characterised by a high glass transition temperature (Tg) of the polymers. Pure polyacrylic acid for example has a high acid number, but is unsuitable at room temperature because of its very high glass transition temperature and the associated brittleness and fragility of the neutralizing layers produced therefrom.

It is also known that the glass transition temperature of acid homopolymers can be reduced by using copolymers which contain as comonomer monomers which reduce the glass transition temperature, such as for example butyl acrylate, 2-ethyl hexyl acrylate. Although the incorporation of comonomers such as these reduced the Tg-value of the polymers, it also results in a considerable, undesirable reduction in their acid number. If these copolymers are used to form the neutralising layer, it is necessary on account of the low acid number to use large quantities of polymer in order to provide the neutralising layer with an adequate neutralisation capacity.

The object of the present invention is to provide polymers containing acid groups which have both a high neutralisation capacity and also a low Tg-value and which therefore show an adequate neutralisation capacity for the dye diffusion process in thin layers.

It has now been found that copolymers of polymerisable acids containing at least 5% by weight of carboxy alkyl (meth) acrylate units are particularly suitable for this purpose.

The present invention relates to a photographic film unit for producing colored transfer images containing, on a dimensionally stable support layer, an image-receiving layer, a photosensitive element containing at least one photosensitive silver halide emulsion layer and, associated therewith, a non-diffusing color providing compound and a neutralizing element consisting of a neutralizing layer and of a retarding layer which delays neutralization, the neutralizing layer consisting mainly of a copolymer essentially containing polymerized units of acid-group-containing copolymerizable monomers and, optionally, up to 10% by weight of polymerized units of copolymerizable monomers free from acid groups, and in which according to the invention the copolymer contains from 5 to 50% by weight of polymerized units of copolymerizable monomers corresponding to the following formula:

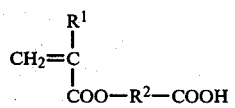

(I)

in which $R^1$ represents hydrogen or methyl, and $R^2$ represents an alkylene group containing from 1 to 3 carbon atoms, which may be branched.

Suitable monomers corresponding to the above formula are, for example β-acryloyloxypropionic acid, methacryloyl oxyacetic acid, and methacryloyl oxybutyric acid.

Compounds such as these may be produced in accordance with generally known principles, as described in the literature. Thus, acrylic acid or methacrylic acid chloride may be reacted with hydroxyalkyl carboxylic acid derivatives, for example esters, and the reaction products thus obtained subsequently converted by selective hydrolysis into the required compounds containing carboxylic acid groups. However, the alkali salts of acrylic acid or methacrylic acid may also be reacted with salts or esters of haloalkyl carboxylic acids and the resulting reaction products may be subjected to selective hydrolysis. Another process, particularly for the production of β-acryloyloxypropionic acid, is described by Sherlin et al in J. Gen. Chem. (USSR), 8, No. 7 (1938).

The last of the above-mentioned compounds, which is also known as carboxyethyl acrylate or dimeric acrylic acid and which is particularly suitable for producing the copolymers according to the invention may also be prepared by heating acrylic acid in the presence of a polymerisation inhibitor using the process described in German Offenlegungsschrift No. 2,800,357. In this process, a mixture of oligomeric acrylic acids corresponding to the following formula $$CH_2{=}CH{-}COO{-}(CH_2{-}CH_2{-}COO)_nH \qquad \text{(II)}$$

in which n is an integer of from 1 to 6, is obtained depending upon the reaction conditions. The unreacted acrylic acid may readily be removed from the reaction mixture by distillation. The dimeric acrylic acid (n=1) may also be isolated by distillation. However, this is not essential for producing the copolymers according to the invention; instead the oligomer mixture may also be used for the copolymerisation reaction.

The copolymer used in accordance with the invention for producing the neutralising layer may be represented by the following formula:

$$(M^1)_x(M^2)_y(CH_2{-}\underset{\underset{COO{-}R^2{-}COOH}{|}}{\overset{\overset{R^1}{|}}{C}})_z \qquad \text{(III)}$$

in which $R^1$ and $R^2$ are as already defined, $M^1$ represents polymerized units of copolymerizable monomers containing acid groups exclusive of those already covered by formula (I); examples are acrylic acid, methacrylic acid, maleic acid, itaconic acid, acrylamidoglycolic acid, 2-acrylamido-2-methyl propane sulfonic acid, sulfoethyl acrylate and vinyl phosphonic acid;

$M^2$ represents polymerized units of copolymerizable monomers free from acid groups; examples are aromatic vinyl compounds (styrene, vinyl toluene, methyl styrene), vinyl ethers, vinyl esters, N-vinyl compounds (vinyl carbazole, vinyl pyrrolidone, vinyl amides), vinyl halides, esters, amides and nitriles of α,β-unsaturated carboxylic acids (acrylic acid esters, methacrylic acid esters, acrylic acid amides, acrylonitrile), olefins (ethylene, propylene, butylene) and allyl compounds (allyl acetate). Particularly suitable monomers are monomers which have a plasticizing effect on the copolymer, for example butyl acrylate. It is also possible to use monomers containing two or more copolymerizable carbon to carbon double bonds as examples of copolymerizable monomers represented by $M^2$ and monomers generally being used in a low concentration, preferably in a concentration of less than 3% by weight, for the copolymerization reaction and which have a crosslinking effect on the copolymer. Other suitable monomers represented by $M^2$ are monomers which contain a copolymerizable double bond and an active methylene group; subsequent crosslinking is possible by reacting this methylene group with hardening agents.

X, y and z represent the percentage contents of the polymerized monomers in the copolymer (in % by weight); more particularly x=from 50 to 95% by weight and preferably from 70 to 95% by weight, y=from 0 to 10% by weight and preferably from 0 to 5% by weight, z=from 5 to 50% by weight and preferably from 5 to 30% by weight.

In formula (III) above, each of the symbols $M^1$ and $M^2$ may represent an individual monomer or a mixture of the corresponding monomers. Where the copolymer contains higher oligomers of acrylic acid (formula II $n \geqq 2$), these higher oligomers are covered by $M^1$. However, they never make up the main quantity of the acid-group-containing copolymerizable monomers represented by $M^1$.

Examples of copolymers which may be used in accordance with the invention for producing the neutralizing layer are given in the following:

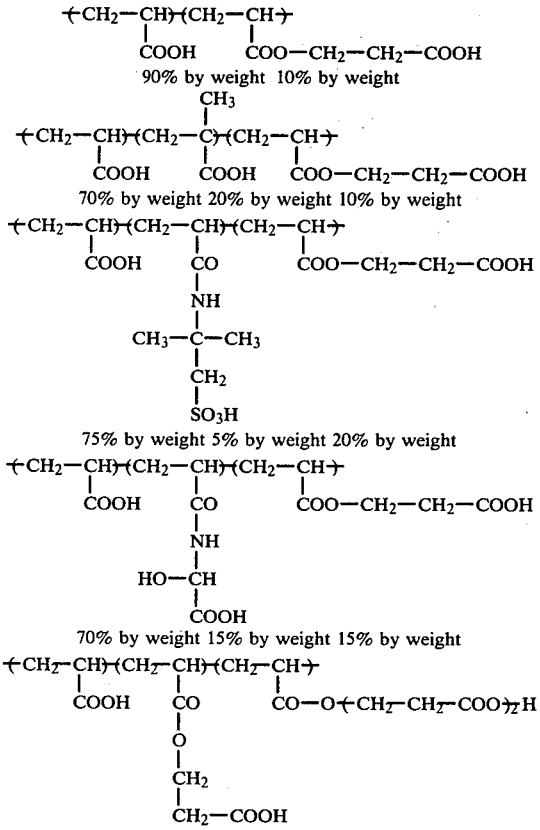

90% by weight 10% by weight

70% by weight 20% by weight 10% by weight

75% by weight 5% by weight 20% by weight

70% by weight 15% by weight 15% by weight

70% by weight 29% by weight 1% by weight

The polymers according to the invention are solid substances. They may be applied from organic solution or in the form of an aqueous dispersion.

The copolymers may be produced by the known processes of solution, precipitation or emulsion polymerization. The polymers have to be purified when the polymerization conditions applied are such that, on completion of polymerization a considerable proportion of residual monomers remains in the polymer. The residual monomers may be removed for example by distillation, dissolution and reprecipitation, dialysis or membrane filtration. Polymerization is preferably carried out in such a way that the non-polymerized fraction of monomers remains small.

The copolymers according to the invention have a glass transition temperature (Tg) of or below 80° C. and an acid number of at least 545 mg of KOH/g of polymer. The glass transition temperature is determined by differential thermoanalysis, a technique known to the expert. The acid number may be determined computationally or in known manner by titration.

The neutralizing layers produced from the polymers according to the invention may be crosslinked to improve their cohesion. Suitable crosslinking agents are any bifunctional or polyfunctional compounds which react with carboxylic acid groups at elevated temperature, such as for example bifunctional or polyfunctional oxiranes, bifunctional or polyfunctional activated vinyl compounds.

As already mentioned, however, the copolymers according to the invention may be crosslinked by carrying out the copolymerization reaction under crosslinking conditions, i.e. in the presence of crosslinking monomers. Crosslinking monomers are understood to be monomeric compounds containing at least two copolymerisable carbon to carbon double bonds which are incorporated into various copolymer chains through the copolymerizable double bonds repeatedly present and, in this way, cause the copolymers to be crosslinked. Examples of suitable crosslinking compounds are tetra-allyl oxyethane, trivinyl cyclohexane, divinyl benzene, 1,7-octadiene or other crosslinking compounds of the type described in Houben-Weyl, Methoden der Organischen Chemie, Makromolekulare Stoffe, Part 1, Georg Thieme, Verlag, Stuttgart, 1961, pages 32, 33. In general, the copolymers only have to be weakly crosslinked, so that the content of crosslinking monomers in the copolymer is kept below 3% by weight.

As already mentioned, crosslinking may also be obtained by using as the monomers $M^2$ copolymerisable compounds containing active methylene groups which react with gelatin hardeners, such as dialdehydes, triacryl formal, bis-vinyl sulfones, in known manner to form polymeric networks. Monomers such as these are described, for example, in German Offenlegungsschriften Nos. 1,547,765 and 2,442,165, for example acetoacetoxyethyl methacrylate, 2-cyanoacetoxyethyl methacrylate and vinylphenyl-2,4-hexane dione.

The neutralizing element consisting of the neutralizing layer according to the invention and the retarding layer may be used in an image-receiving sheet for the dye diffusion transfer process provided that the image-receiving layer is separated from the photosensitive element on completion of development. However, the preferred and main use is in dye diffusion transfer materials of the integral type, i.e. in monosheet materials where the image-receiving element is not separated from the photosensitive element.

A monosheet material suitable for carrying out the dye diffusion transfer process in accordance with the present invention comprises for example the following layer elements:

(1) a transparent support layer,
(2) an image-receiving layer,
(3) a light-impermeable layer,
(4) a photosensitive element containing at least one photosensitive silver halide emulsion layer and at least on color providing compound associated therewith,
(5) a retarding layer,
(6) an acid polymer layer (neutralizing layer),
(7) a transparent support layer.

The film unit may be made up by separately producing two different parts, namely the photosensitive part (layer elements 1 to 4) and the cover sheet (layer elements 5–7) which are then placed with the layer side one on top of the other and joined together, optionally using spacer strips, so that a space for accommodating an exactly measured amount of a working fluid is formed between the two parts. The layer elements 5 and 6, which together form the neutralizing element, may even be additionally or alternatively arranged, but in the opposite order, between the support layer 1 and the image-receiving layer 2 of the photosensitive part.

Means may also be provided for introducing a processing liquid between two adjacent layers of the monosheet material, for example in the form of a laterally arranged, rupturable container which, under the action of mechanical forces, releases its content between two adjacent layers of the monosheet material, in the present case between the photosensitive part and the cover sheet.

Under the effect of the alkaline processing liquid a relatively high pH-value (approximately 11 to 14) is adjusted in the photosensitive material, initiating development and the image-wise diffusion of the dyes. It has been found that, at this high pH-value, the dyes and layer assemblies and, hence, the images obtained therein are not particularly stable. Accordingly, the material has to be substantially neutralized or weakly acidified on completion of development. This is done in known manner by additionally incorporating in the material an acid polymer layer (neutralizing layer) which only becomes gradually accessible to the alkaline processing liquid as development progresses. According to the invention, a neutralizing layer is understood to be a layer which is made up of a copolymer of an ethylenically unsaturated copolymerizable acid and a copolymerizable compound corresponding to formula (I). The acid groups react with the hydroxyl groups of the processing liquid to form water and, in doing so, reduce the pH-value of the fluid.

The acid polymerisation layer (neutralizing layer) according to the invention contains enough acid groups, even in thin layers, to reduce the pH-value of the processing liquid from its initial value of from 11 to 14 to such an extent that, finally, the material is substantially neutral or weakly acid (pH-value 5–8).

The delay in the reduction of the pH-value is obtained in known manner by coating the acid polymer layer with a so-called retarding layer. This retarding layer contains a polymer that can only slowly be penetrated by diffusing alkali, so that the reduction in pH only occurs with delay, and together with the acid polymer layer forms the neutralizing element according to the present invention. It is obvious that the retarding layer has to be arranged within the layer structure between the acid polymer layer and the image-receiving layer. The retarding layer according to the invention is preferably produced by casting the corresponding polymers from aqueous solution followed by drying. The thickness of the retarding layer is determined by the required retarding time (development time) and is generally between 2 to 20$\mu$.

An important part of the photographic material according to the present invention is the photosensitive element which, in the case of a single dye diffusion transfer process, contains a photosensitive silver halide emulsion layer and a color-providing compound associated therewith. The color-providing compound may be accommodated in a layer adjacent the silver halide emulsion layer or in the silver halide emulsion layer itself. In the latter case, the color of the image dye is preferably selected in such a way that the predominant absorption range of the color-providing compounds does not coincide with the predominant sensitivity range of the silver halide emulsion layer. For producing multicolored transfer images in natural colors, however, the photosensitive element contains three such associations of color-providing compound and photosensitive silver halide emulsion layer, the absorption range of color providing compound generally coinciding to a large extent with the spectral sensitivity range of the associated silver halide emulsion layer. In that case, however, a precondition for as high a sensitivity level as possible is that the color-providing compound should be accommodated in a separate binder layer behind the silver halide emulsion layer, looking in the direction of the incident light during exposure.

The developer oxidation products formed during the development of a silver halide emulsion should of course affect only the associated color-providing compound. Accordingly, the photosensitive element generally contains separation layers which effectively prevent the developer oxidation products from diffusing into other non-associated layers. These separation layers may contain for example suitable substances which react with the developer oxidation products, for example non-diffusing hydroquinone derivatives or, where the developer compound is a color developer compound, non-diffusing color couplers.

In the silver halide emulsion layers or in layers adjacent thereto, the photosensitive element contains substances which are capable during development of forming an image-wise distribution of a diffusible image dye. Substances such as these are referred to hereinafter as color-providing compounds. In principle, suitable color-providing compounds are any compounds which give diffusing dyes during development of the photosensitive element. They may be colored compounds which are themselves capable of diffusing and which begin to diffuse when the layers are treated with an alkaline processing liquid, being fixed by development in only the exposed areas. However, the color-providing compounds may also be resistant to diffusion and may release a diffusing dye during development.

Color-providing compounds which are capable of diffusion apriori are known for example from German Pat. Nos. 1,036,640; 1,111,936 and 1,196,075. The so-called dye developers described therein contain, in the same molecule, a dye residue and a group which is capable of developing exposed silver halide.

Among the previously known processes for producing colored photographic images by the dye diffusion transfer process, increasing importance has recently been attached to those processes which are based on the use of color-providing compounds incorporated in diffusion-resistant form, from which diffusing dyes or dye precursors are released image-wise during development and transferred to an image-receiving layer.

Color-providing compounds suitable for these processes include for example the non-diffusing color couplers described in German Pat. No. 1,095,115 which, on development, release a preformed dye or a dye produced during the color coupling reaction in diffusing form in consequence of a reaction with the oxidation product of a color developer compound consisting of a primary aromatic amine. The range of developer compounds required in this case is of course confined to color developers.

In addition, reference is made to the non-diffusing color providing compounds described in German Offenlegungsschrift No. 1,930,215 which, through a releasable hydrazone group, contain a preformed latently diffusible dye residue attached to a radical which imparts resistance to diffusion. These compounds are not color couplers and it has also been found that the range of developer compounds required for releasing the diffusing dye residue is by no means confined to the usual color developers, instead black-and-white developers, for example pyrocatechols, may also be effectively used.

In addition, German Offenlegungsschrift No. 1,772,929 describes non-diffusing colored compounds containing a special group which, on development, enter into an oxidative ring-closing reaction and, in doing so, release a preformed dye residue in diffusing form. The compounds in question may be divided into two groups. The compounds of one group require for development a standard color developer compound with whose oxidation product they couple and release the preformed dye residue in diffusing form in a subsequent ring-closing reaction. The compounds belonging to the other group are themselves silver halide developers and are therefore capable, even in the absence of further developer compounds, of entering into the above-mentioned ring-closing reaction in oxidised form to release the diffusing dyes.

In addition, reference is made at this juncture to the non-diffusing color-providing compounds described in German Offenlegungsschrift No. 2,242,762. The compounds in question are sulfonamidophenols and sulfonamidoanilines which, after oxidation during development, release diffusing dyes under the effect of the developer alkali. The non-diffusing color providing compounds described in German Offenlegungsschriften Nos. 2,505,248 and 2,645,656, for example 3-sulfonamidoindole derivatives, also react in similar fashion. In this connection, reference is also made to Research Disclosure Publication No. 15 654 (1977).

The above-mentioned non-diffusing color providing compounds all work negatively, in other words the imagewise distribution of the diffusing dye released is formed in consistency with the negative silver image produced during development where standard (negatively working) silver halide emulsions are used. To produce positive dye images, therefore, it is necessary to use direct positive silver halide emulsions or, alternatively, a suitable reversal process.

One such reversal process is available in the silver salt diffusion process. Photographic reversal by the silver salt diffusion process to produce positive colored images using conventional color couplers is described for example in U.S. Pat. No. 2,763,800. Replacement of the color couplers by the above-mentioned color providing compounds gives a photosensitive element which is suitable for the dye diffusion transfer process. A photosensitive element such as this comprises for example at least one combination of a photosensitive silver halide emulsion layer and, associated therewith, a binder layer which contains development nuclei for the physical development process and a color-providing compound.

During development, the exposed part of the silver halide is developed chemically in the photosensitive silver halide emulsion layer. The unexposed part is transferred by means of a silver halide solvent to the associated binder layer containing development nuclei and is physically developed there. Where a developer which is capable in oxidized form of releasing a diffusing dye as a result of a reaction with the color-providing compound present in that layer is used for physical development, an imagewise distribution of diffusing dyes is formed and may be transferred to an image-receiving layer to form a positive colored image thereon.

Where compounds which release development inhibitors in imagewise distribution are used for reversal, the photosensitive element consists of at least one layer combination of a photosenstive silver halide emulsion layer and a second emulsion layer containing the color-providing compound which may be developed without exposure. The photosensitive silver halide emulsion layer is developed for example with color developers in the presence of certain compound which release development-inhibiting substances during the reaction with oxidised colour developer. The development-inhibiting substances released imagewise in the photosensitive layer diffuse into the adjacent emulsion layer which may be developed without exposure and inhibit development imagewise in this emulsion layer. The non-inhibited (positive) parts of the emulsion layer developable without exposure are developed by the residual developer whose oxidation products then react with the non-diffusing color-providing compounds to release diffusing dyes which are transferred imagewise to the image-receiving element. Suitable compounds which release development-inhibiting substances on reaction with color developer oxidation products are, for example, the known DIR (development inhibitor releasing) couplers, i.e. color couplers which contain a releasable inhibitor residue in the coupling position. DIR couplers such as these are described for example in U.S. Pat. No. 3,227,554.

Another group of compounds which release development-inhibiting substances on reaction with color developer oxidation products is described in U.S. Pat. No. 3,632,345. These compounds are not color couplers. Accordingly, no dyes are formed during the release of the development-inhibiting substances. Very similar compounds are also described in German Offenlegungsschrift No. 2,359,295. Finally, according to German Pat. No. 1,229,389, it is also possible in a process such as this to use suitably substituted, non-diffusing hydroquinone compounds which, on reaction with developer oxidation products, are oxidised to form the corresponding quinones and, at the same time, release development-inhibiting mercaptans.

Suitable direct positive silver halide emulsions are, in principle, any direct positive silver halide emulsions which, on simple development, produce a positive silver image and a corresponding imagewise distribution of developer oxidation products. For example, it is possible to use silver halide emulsion of the type in which a developable fog has been produced by exposure or by chemical treatment, the fog being destroyed imagewise by maintaining certain conditions during imagewise exposure. The fog remains intact in the unexposed area so that a direct positive silver image and, in consistency therewith, an imagewise distribution of diffusing dye is obtained during subsequent development where a color-providing compound is associated with the direct positive silver halide emulsion.

Another group of direct positive silver halide emulsions which may be used with advantage in accordance with the invention comprises the so-called unfogged direct positive silver halide emulsions which are predominantly photosensitive in the interior of the silver halide grains. When emulsions such as these are exposed imagewise, a latent image is formed predominantly in the interior of the silver halide grains. However, the development of unfogged direct positive silver halide emulsions such as these is carried out under fogged conditions where a fog is produced predominantly in the unexposed area and a positive silver image is developed during development. The unfogged, direct positive silver halide emulsions are characterised in that, on development using a typical surface developer having the following composition:

| | |
|---|---|
| p-hydroxyphenyl glycine | 10 g |
| Sodium carbonate (crystallised) | 100 g |
| made up with water to | 1000 ml, |

exposed samples preferably produced no silver image or a silver image of only very low density, whereas where an internal image developer having the following compositions:

| | |
|---|---|
| hydroquinone | 15 g |
| monomethyl-p-aminophenol sulfate | 15 g |
| sodium sulfite (anhydrous) | 50 g |
| potassium bromide | 10 g |
| sodium hydroxide | 25 g |
| sodium thiosulfate (crystallized) | 20 g |
| made up with water to | 1000 ml |

is used, a silver image of adequate density is formed.

The selective fogging of the unfogged direct positive emulsions which have been exposed imagewise may be carried out before or during development by treatment with a fogging agent. Suitable fogging agents are reducing agents, such as hydrazine or substituted hydrazines, cf. U.S. Pat. No. 3,227,552.

Unfogged, direct positive emulsions are, for example, emulsions which contain faults inside the silver halide grains (U.S. Pat. No. 2,592,250) or silver halide emulsions having a laminar grain structure (German Offenlegungsschrift No. 2,308,239).

However, positive dye transfer images may also be produced using standard negative emulsions without any need for a reversal process of the type described above, for example in cases where the color-providing compounds used are compounds containing a non-diffusing oxidizable carrier residue which is only released in non-oxidized form under the influence of the developer alkali, whereas it is converted by oxidation into a form in which release is either prevented or made very difficult. Non-diffusing color-providing compounds such as these are described, for example, in German Offenlegungsschrifen Nos. 2,402,900, 2,543,902 and 2,823,159.

The light-impermeable layer arranged below the photosensitive element is permeable to aqueous alkaline treatment solutions and, hence, to the diffusing dyes. It performs essentially two functions. Firstly, it masks both the image silver remaining after development in the originally photosensitive element and the color providing compounds left behind as color negative, so that only the positive dye transfer image is visible through the transparent support layer of the photosensitive part. Secondly, it seals off the photosensitive element against light on the side of the image-receiving layer (downwards). This is particularly important when the monosheet material is intended to be brought into contact with the alkaline processing liquid after exposure inside the camera, subsequently removed from the camera and developed outside the camera.

Layers having adequate impermeability to light, but adequate permeability to diffusing dyes may be produced for example with suspensions of inorganic or organic, dark, preferably black pigments, for example with suspensions of carbon black in suitable binders, for example in gelatin solutions. Layers from 0.5 to 2 μm thick which contains from 10 to 90% by weight of carbon black (based on the total dry weight) in gelatin are generally sufficient for adequately excluding light during development. The particle size of the pigments used is relatively non-critical, provided that it does not significantly exceed 0.5 μm.

In addition to the black pigment layer, the light-impermeable layer preferably comprises a white pigment layer arranged below the black pigment layer. The function of this white pigment layer is to mask the black layer and to provide a white background for the image. Any white pigments may be used for this white pigment layer, providing their covering power is sufficiently high in reasonable layer thicknesses. Suitable white pigments are, for example, barium sulfate, oxides of zinc, titanium, silicon, aluminium and zirconium, also barium stearate or kaolin. Titanium dioxide is preferably used as the white pigment. The white pigments are governed by the same requirements as the black pigments both in regard to their concentration and particle size and in regard to the binder used. The thickness of the white pigment layer may be varied according to the required whiteness of the background. The white pigment is preferably used in layer thicknesses of from 2 to 20 μm.

Instead of the light-impermeable layer, it is also possible in the film unit according to the invention to arrange means for producing a light-impermeable layer between the photosensitive element and the image-receiving layer, for example in the form of a laterally arranged container filled with a processing liquid containing an opacifier (pigment) which, under the effect of mechanical forces, releases its contents between the above-mentioned layers so that a pigment layer of the type required is formed there.

The image-receiving layer essentially consists of a binder which contains dye mordants for fixing the diffusing acid dyes.

Preferred mordants for acid dyes are long-chain quaternary ammonium or phosphonium compounds or tertiary sulfonium compounds, for example those described in U.S. Pat. Nos. 3,271,147 and 3,371,148, or polymers containing quaternary ammonium groups, for example according to German Offenlegungsschrift No. 2,631,521. It is also possible to use certain metal salts and their hydroxides which form substantially insoluble compounds with the acid dyes. The dye mordants are dispersed in one of the usual hydrophilic binders, for example in gelatin, polyvinyl pyrrolidone or a completely or partially hydrolysed cellulose ester, in the receiving layer. Certain binders may of course also function as mordants, for example copolymers or polymer mixtures of vinyl alcohol and N-vinyl pyrrolidone, of the type described for example in German Auslegeschrift No. 1,130,284, also binders formed by polymers of nitrogen-containing quaternary bases, for example polymers of N-methyl-2-vinyl pyridine, as described for example in U.S. Pat. No. 2,484,430. Other suitable mordant binders are, for example, guanyl hydrazone derivatives of alkyl vinyl ketone polymers, as described for example in U.S. Pat. No. 3,882,156 or guanyl hydrazone derivatives of acyl styrene polymers, as described for example in German Offenlegungsschrift No. 2,009,498. In general, however, other binders, for example gelatin, will generally be added to these mordant binders.

Suitable transparent support layers for the monosheet material according to the invention are the usual transparent support materials normally used in photography, for example films of cellulose esters, polyethylene terephthalate, polycarbonate or other film-forming polymers.

For processing, the photosensitive element is treated after image-wise exposure with an aqueous-alkaline developer preparation and brought into contact with the image-receiving element. In the case of monosheet materials, the developer liquid is pressed in between two layers of the monosheet. In addition to the aqueous alkali, the developer preparation also contains developer compounds which, however, have to be coordinated with the particular color-providing compounds used. Further possible ingredients of the developer preparation are thickeners for increasing viscosity, for example hydroxyethyl cellulose, silver halide solvents, for example sodium thiosulfate or any of the bis-sulfonyl alkane compounds described in German Offenlegungsschrift No. 2,126,661, opacifiers for producing opaque layers, for example pigments of $TiO_2$, ZnO, barium stearate or kaolin. Alternatively or in addition, some of these ingredients may even be incorporated in one or more layers of monosheet materials. Thus, in a particularly preferred embodiment for example, non-diffusing developer compounds are incorporated in layers of the photosensitive element, whereas the developer preparation itself only contains small quantities of a diffusing auxiliary developer compound. In this connection, reference is made to German Offenlegungsschrifts Nos. 2,327,963 and 2,335,179.

The production of some of the polymers used according to the invention is described in the following Examples and Comparison Example.

EXAMPLE 1

A mixture of 500 ml of tolene and 100 ml of cyclohexane is heated to 65° C. while nitrogen is passed through. A solution of 2 g of benzoyl peroxide in 100 ml of toluene and a mixture of 50 g of dimeric acrylic acid and 50 g of acrylic acid are then simultaneously added dropwise over a period of 1 hour. After stirring for 4 hours at 65° C., the polymer formed is filtered under suction, washed with 200 ml of cyclohexane and dried. The polymer forms a clear solution in methanol. To determine the glass transition temperature, a sample of the polymer is purified by dissolution in and reprecipitation from methanol in methylene chloride.

EXAMPLE 2 to 5

The procedure is as in Example 1, except that the monomers identified in Table 1 are used. In Example 5, the monomer mixture contains 40 ml of methanol.

TABLE 1

| Polymer Example | Production from dimeric acrylic acid | acrylic acid | |
|---|---|---|---|
| 1 | 50 g | 50 g | — |
| 2 | 30 g | 70 g | — |
| 3 | 10 g | 90 g | — |
| 4 | 10 g | 70 g | 20 g of methacrylic acid |
| 5 | 10 g | 70 g | 20 g of maleic acid |

| | Polymer Example | Acid No (AN) | Glass transition temperature [K] |
|---|---|---|---|
| | 1 | 583 | 293 |
| | 2 | 662 | 295 |
| | 3 | 739 | 305 |
| | 4 | 714 | 308 |
| | 5 | 777 | 308 |
| Comparison Example | copoly(acrylic acid/butyl acrylate) 70/30% by weight according to Res. Discl. | 545 | 353 |

The Comparative Example shows that all of the polymers produced with dimeric acrylic acid as comonomer have a higher acid capacity than the comparison polymer and, at the same time, a lower glass transition temperature.

APPLICATION EXAMPLE 1 (Comparison Example)

(A) The photosensitive part of a photographic film unit according to the invention was produced by successively applying the following layers to a 150 μm thick transparent support of polyester film. The quantities indicated are based in each case on one square meter. For the structural formulae of compounds A to D, see appendix.

(1) Mordant layer of
- 3.0 g of a polyurethane of 4,4-'-diisocyanatodiphenyl methane, 1-isocyanato-5-isocyanatomethyl-3,3,5-trimethyl cyclohexane and N-ethyl diethanolamine quaternized with epichlorohydrin and diethyl sulfate, according to German Offenlegungsschrift No. 2,631,521,
- 3.15 g of gelatin.

(2) White pigment layer of
- 18 g of titanium dioxide,
- 2.6 g of gelatin.

(3) Black pigment layer of
- 1.9 g of carbon black,
- 2.1 g of gelatin.

(4) Cyan dye layer of
- 0.53 g of compound A,
- 1.06 g of gelatin.

(5) Red-sensitized silver halide emulsion layer containing an unfogged, direct positive silver chloride bromide emulsion of
- 1.27 g of silver,
- 1.66 g of gelatin
- 17 g of octadecyl hydroquinone sulfonic acid per mole of silver halide,
- 1.13 mg of 1-formyl hydrazinophenyl-3-phenyl-2-thiourea per mole of silver halide.

(6) Barrier layer of
- 1 g of octadecyl hydroquinone sulfonic acid,
- 1 g of gelatin.

(7) Magenta dye layer of
- 0.53 g of compound B,
- 1.06 g of gelatin.

(8) Green-sensitized silver halide emulsion layer containing unfogged, direct positive silver chloride bromide emulsion of
- 1.27 g of silver,
- 1.66 g of gelatin
- 17 g of octadecyl hydroquinone sulfonic acid per mole of silver halide,
- 3.39 mg of 1-formyl hydrazinophenyl-3-phenyl-2-thiourea per mole of silver halide,
- 158.6 mg of 1-phenyl-2-((2,4-di-t-phenyl)-phenoxy acetyl)-hydrazine per mole of silver halide.

(9) Barrier layer identical with layer No. 6).

(10) Yellow dye layer of
- 0.86 g of compound C,
- 1.29 g of gelatin.

(11) Blue-sensitive silver halide emulsion layer containing an unfogged, direct positive silver chloride bromide emulsion of
- 1.27 g of silver
- 1.66 g of gelatin
- 3.39 mg of 1-formyl hydrazinophenyl-3-phenyl2-thiourea per mole of silver halide,
- 288.3 mg of 1-phenyl-2-((2,4-di-t-pentyl)-phenoxyacetyl)-hydrazine per mole of silver halide.

(12) Protective layer of
- 0.1 g of octadecyl hydroquinone sulfonic acid,
- 1.0 g of gelatin

(13) Hardening layer of
- 0.4 g of hardener (compound D),
- 0.8 g of gelatin.

(14) Adhesion layer of
- 1.0 g of terpolymer latex of vinylidene chloride, methyl acrylate and itaconic acid in a ratio of 55:39:6.

B. The cover sheet containing the neutralizing element was produced by successively applying the following three layers to a transparent support made of 100 μm thick polyester film:

| | | |
|---|---|---|
| 1. | Neutralizing layer of 9 g of a copolymer of 70 parts of acrylic acid and 30 parts of butyl acrylate (cf. French Pat. No. 2,290,699) | |
| 2. | First retarding layer of 4.5 g applied from a mixture of: | |
| | Cellulose acetate (40% acetyl) "LM 45", a Hercules product | 4.0 g |
| | Copolymer of styrene and maleic acid anhydride ("Lytron 810", a Monsanto product) | 0.24 g |
| | acetone | 83 ml |
| | methanol | 17 ml |
| | fluorine surfactant (10% in acetone) ("FC 430", a 3 M product) | 1.5 ml |
| 3. | Second retarding layer of 2.2 g of a terpolymer of vinylidene chloride, methacrylate, itaconic acid in | |

-continued a ratio of 55:39:6, applied in the form of a latex.

One sheet of the photosensitive part A and one of the cover sheet B were placed with the layer sides on top of one another with two 100 μm thick spacer strips laterally arranged in between, a bag filled with developer paste being arranged at one end and a trap for excess developer at the other end. The set thus formed was exposed through an exposure original (grey wedge and color separations) and subsequently passed through a pair of squeezing rollers which caused the developer paste to spread out between the photosensitive part and the cover sheet. The developer paste had the following composition:

1.5 ml of benzyl alcohol,
34 g of Natrosol HHR (hydroxyethyl cellulose, a commercial product of the Hercules Powder Company),
4 g of 4-methyl-4-hydroxymethyl 1-phenyl-3-pyrazolidone
0.2 g of hydroquinone,
110.0 g of carbon black,
56.0 g of potassium hydroxide,
2.75 g of 5-methyl benzotriazole,
1.0 g of sodium sulfite,
made up with water to 1 liter.

After development, a positive image of the original was visible through the transparent support on the $TiO_2$ layer as the image background.

APPLICATION EXAMPLE 2

A film unit was made up and processed in the same way as in Application Example 1, except that a copolymer of 90 parts of acrylic acid and 10 parts of dimeric acrylic acid (Example 3) was used for the neutralizing layer. Commensurate with the higher neutralization capacity of the polymer (cf. AN in Table 1), only 12.5 g/m$^2$ were applied on this occasion. The image sheet processed with this cover sheet and the above paste according to Example 1 gave a positive image of the original with very good color quality and outstanding durability. The thickness of the neutralizing layer way considerably reduced in relation to Application Example 1.

APPLICATION EXAMPLE 3

Results as good as those of Application Example 2 were obtained using a neutralizing layer of 13 g of copolymer of 10 parts of dimeric acrylic acid, 70 parts of acrylic acid and 20 parts of methacrylic acid (Example 4).

A

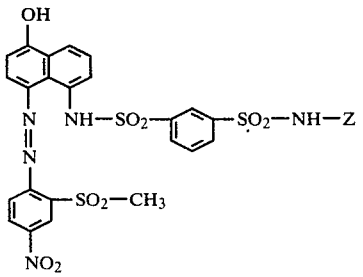

-continued

B

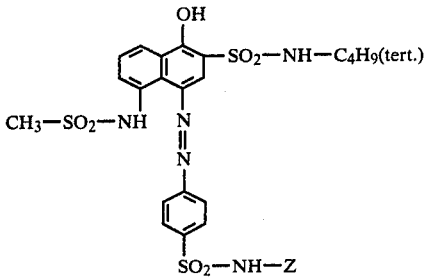

C

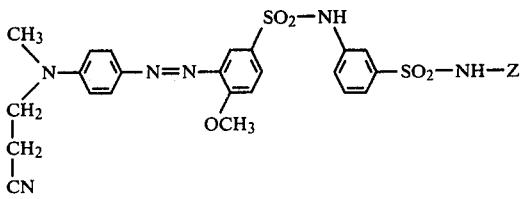

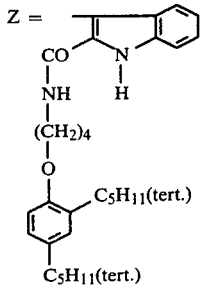

D

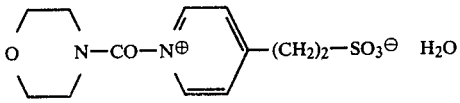

We claim:

1. In a photographic film unit for producing colored transfer images containing on a dimensionally stable support layer an image-receiving layer, a photosensitive element comprising at least one photosensitive silver halide emulsion layer and associated thereto a non-diffusing color-providing compound, and a neutralizing element consisting of a neutralizing layer and of a retarding layer which delays neutralization, the neutralizing layer consisting of a copolymer essentially containing polymerized units of ethylenically unsaturated monomers containing acid groups and, optionally, up to 10% by weight of polymerized units of ethylenically unsaturated monomers free from acid groups, the improvement according to which the copolymer contains from 5 to 50% by weight of polymerized units of ethylenically unsaturated monomers corresponding to the following formula

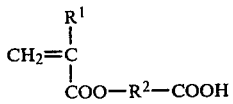

in which $R^1$ represents hydrogen or methyl and $R^2$ represents an alkylene group containing from 1 to 3 carbon atoms.

2. A film unit as claimed in claim 1, in which the copolymer used in the neutralizing layer corresponds to the following formula

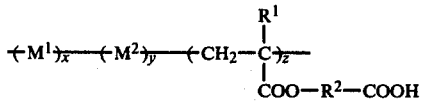

in which $R^1$ represents hydrogen or methyl, $R^2$ represents an alkylene group containing from 1 to 3 carbon atoms, $M^1$ represents polymerized units of copolymerizable ethylenically unsaturated monomers containing acid groups selected from the group consisting of acrylic acid, methacrylic acid, maleic acid, itaconic acid, acrylamido-glycolic acid, 2-acrylamido-2-methyl propane sulfonic acid, sulfoethyl acrylate and vinyl phosphonic acid, $M^2$ represents polymerized units of copolymerizable ethylenically unsaturated monomers free from acid groups, x, y, z are the percentage contents of the polymerized monomers in the copolymer (in percent by weight) with x=from 50 to 95% by weight, y=from 0 to 10% by weight, z=from 5 to 50% by weight.

3. A film unit as claimed in claim 2, characterised in that $M^2$ represents polymerized units of acetoacetoxy ethyl acrylate.

4. A film unit as claimed in claim 1, characterised in that the copolymer contains from 5 to 50% by weight of polymerised units of dimeric acrylic acid.

* * * * *